United States Patent [19]

Akkerman et al.

[11] Patent Number: 4,852,648

[45] Date of Patent: Aug. 1, 1989

[54] WELL INSTALLATION IN WHICH ELECTRICAL CURRENT IS SUPPLIED FOR A SOURCE AT THE WELLHEAD TO AN ELECTRICALLY RESPONSIVE DEVICE LOCATED A SUBSTANTIAL DISTANCE BELOW THE WELLHEAD

[75] Inventors: Neil H. Akkerman; Daniel O. Dewey, both of Houston, Tex.

[73] Assignee: AVA International Corporation, Houston, Tex.

[21] Appl. No.: 128,724

[22] Filed: Dec. 4, 1987

[51] Int. Cl.[4] ..... E21B 23/00; E21B 34/06; E21B 43/12; E21B 41/00

[52] U.S. Cl. ..... 166/66.4; 166/65.1; 166/66.5; 166/72; 439/11; 336/DIG. 2

[58] Field of Search ..... 166/65.1, 66.4, 66.5, 166/72, 67, 75.1, 316; 439/11-14, 18, 20, 21, 23; 336/DIG. 2; 251/65, 129.1, 129.21

[56] References Cited

U.S. PATENT DOCUMENTS

| | | | |
|---|---|---|---|
| 2,370,818 | 3/1945 | Silverman | 336/DIG. 2 X |
| 2,379,800 | 7/1945 | Hare | 336/DIG. 2 X |
| 2,414,719 | 1/1947 | Cloud | 336/DIG. 2 X |
| 3,187,238 | 6/1965 | Wilson et al. | 166/66.5 X |
| 3,550,682 | 12/1970 | Fowler | 336/DIG. 2 |
| 3,743,989 | 7/1973 | Nicolas et al. | 336/DIG. 2 X |
| 4,407,329 | 10/1983 | Huebsch et al. | 166/66.4 X |
| 4,566,534 | 1/1986 | Going, III | 166/66.4 |

FOREIGN PATENT DOCUMENTS 2058474 11/1983 United Kingdom .

OTHER PUBLICATIONS

"Inductive Couplers in Underwater Power Distribution Networks-Improving Their Applicability" by L. Van Den Steen, published in *Underwater Technology,* vol. 12, No. 3, date unknown.

*Primary Examiner*—Bruce M. Kisliuk
*Attorney, Agent, or Firm*—Vaden, Eickenroht, Thompson & Boulware

[57] ABSTRACT

There is disclosed a well installation having an electrically responsive device a substantial distance beneath the wellhead and apparatus for supplying electrical current to the device from a source of alternating or time varying current outside the wellhead, which apparatus includes an electrical connector comprising a first coil on the outer side and a second coil on the inner side of a non-magnetic portion of a pressure containing wall of the well, whereby the supply of varying current from the source to the first coil forms an inductive coupling between it and the second coil of the connector.

27 Claims, 5 Drawing Sheets

28
34
39
38
41
43
43A
45
42
66
53
63
54
55
25
44
118
50
49
52
47
48
70
67
72
73
30
74
118
119
117
90

114 A
65
61
46
53
60
81
51
62
71
80
79
121
68
119
116
115

WELL INSTALLATION IN WHICH ELECTRICAL CURRENT IS SUPPLIED FOR A SOURCE AT THE WELLHEAD TO AN ELECTRICALLY RESPONSIVE DEVICE LOCATED A SUBSTANTIAL DISTANCE BELOW THE WELLHEAD

This invention relates in general to a well installation in which electrical current is adapted to be supplied from a source at the head of the well to an electrically responsive device which is located a substantial distance below the wellhead. More particularly, it relates to improvements in a well installation of this type in which the device is a latch is adapted to be maintained in a position holding a downhole safety valve within the well tubing in the open position, in response to the supply of electrical current from such source, and then permitted to move to the closed position upon termination of the supply of electrical current. In one of its aspects, this invention relates to such a well installation having improved electrical connectors which form electrical connections between electrical conductors on opposite sides of one or more well conduits or other pressure containing walls of the well installation in order to supply the electrical current to the electrically responsive device.

Since conventional electrical connectors must penetrate the pressure containing wall or walls of the wellhead and/or tubing hanger at the upper end of the well and/or the tubing string or packer deep within the well, they pose potential leak paths for the high pressure, ambient well fluids. Additionally, conventional connectors utilize pin and socket "wet" parts which are exposed to either well fluids or ambient conditions during well completions, and thus are not suitable for long term, reliable service in offshore or subsea wells. Also, it is difficult to realize the accurate orientation required during make up of wet connectors in a well.

An object of this invention is to provide a well installation of this type having electrical connectors which neither penetrate the pressure containing wall or walls nor expose electrically conductive parts to the well fluids or ambient conditions, and, more especially, which are automatically made up or broken out regardless of rotational orientation and automatically in response to relative axial movement between the well conduits and/or a body within the conduits on which the device may be mounted, as may occur during wireline operations, completion or workover of the well.

Copending application, Ser. No. 922,846, filed Oct. 24, 1986, and entitled "Valves", now U.S. Pat. No. 4,768,594, discloses a safety valve which is installed a substantial distance beneath the wellhead and which includes a latch in the form of a solenoid which is electrically energized to a position to hold the valve open in response to electromagnetic signals transmitted through the earth and a control system responsive to the supply or loss of electrical power to the solenoid latch from batteries within the well near the device. However, the electromagnetically responsive control system has non-fail safe failure modes that may result in battery power supply to the solenoid latch even if the electromagnetic signals are lost.

It is therefore another object of this invention is to provide a well installation of this type including one or more electrical connectors which, in addition to accomplishing the above described object, are especially well suited for controlling the electrically responsive latch of a downhole valve of this type in such a manner that the valve will close upon termination of power supply or control signal.

This and other objects are accomplished, in accordance with the illustrated embodiment of the present invention, by a well installation including electrical connectors each comprising a first coil outside a non-magnetic portion of a pressure containing wall of the well, and a second coil inside the non-magnetic portion of the wall generally opposite the first coil. More particularly, each connector also includes a first conductor for supplying alternating or time varying current from a source of electrical power outside the wall to the first coil and thereby forming an inductive coupler between the first and second coils, and a second conductor for supplying such electrical current to the electrically responsive device within the well inside of the wall. Thus, the electrical connectors are made up or completed merely upon disposal of the coils in the positions indicated, and the supply of alternating or time varying current to the first coil. Furthermore, the coils may be enclosed to prevent their exposure to wet well fluids or other undesirable ambient conditions, provided that any portions of the enclosure walls between the coils are non-magnetic.

Preferably, the coils are of annular shape and disposed concentrically of one another so that they need not be oriented rotationally. In fact, when mounted on well conduits on internal bodies of the well disposable concentrically within the well conduits, the annular coils are automatically made up as the conduits and bodies are lowered into the well or broken out as they are raised.

In one form of the connector, the wall is a well conduit disposable in spaced concentric relation with respect to another well conduit to form an annulus therebetween for the contained well fluid, as for example between a wellhead and a tubing string suspended therefrom. In another form, the wall is an inner well conduit such as a lower portion of the tubing string disposable within the well a substantial distance below the head of the wellhead, with a body on which the electrically responsive device is mounted being located concentrically within the tubing string to form an annular space between them in which the well fluid is contained.

In the illustrated and preferred embodiment of the invention, electrical current is supplied to the device from the source outside the well conduit by first and second connectors, the first connector including a first coil outside a non-magnetic portion of the outer well conduit, and a second coil mounted on an inner well conduit generally opposite the first coil, as well as a first conductor extending from the source to connect with the first coil for supplying alternating or time varying current to it, and a second connector which includes a first coil outside a non-magnetic portion of the inner well conduit, and a second coil mounted on an inner device carrying body opposite the first coil. In this illustrated and preferred embodiment, the second conductor extends within the annulus between the well conduits to connect the second coil of the first connector with the first coil of the second connector in order to supply alternating or time varying current thereto and thereby form another inductive coupling between the first and second coils of the second connector and a third conductor extends from the second coil of the second connector to connect with the device. As illustrated, the first connector is at the head of the well and the device and second connector are a substantial distance beneath the wellhead.

More particularly, the outer well conduit comprises a wellhead from which casing string is suspended within the well bore, and the inner well conduit comprises a tubular body connectable as part of the tubing string suspended from a tubing hanger supportable from the wellhead. Thus, the connector comprises a first annular coil mounted about a non-magnetic portion of the casing head, a second annular coil mounted on the tubular body suspended from the tubing hanger to dispose the second coil concentrically within and opposite the first coil when the tubing hanger is supported from the wellhead. In the preferred and illustrated embodiment, the first coil of the connector is mounted on a spool which is connected as part of the wellhead intermediate tubing and casing heads of the wellhead.

The well installation further includes a safety valve which is similar to that disclosed in the above mentioned patent application in that it includes a closure member movable within the lower end of the tubing string for opening and closing the string a substantial distance beneath the wellhead, a means urging the closure member toward closed position, and a latch which is movable to and maintained in a position holding the closure member in open position, in response to the supply of electrical current thereto, and which is permitted to move to a position releasing the closure member for movement to closed position in response to the loss of such supply. Moreover, in accordance with the present invention, the second electrical connector includes the first coil mounted on and about a non-magnetic portion of the lower portion of the tubing string, and a second coil mounted on the body in which the closure member is supported, with the conductor extending from the second coil of the first connector to connect with the first coil of the second connector located within the annulus between the casing and tubing string, in order to inductively couple the first and second coils of the second connector, and a further conductor extending from the second coil of the second connector to a rectifier for converting the alternating or time varying current to direct or constant polarity current and thus operating a latch in the form of a magnetic solenoid.

In the drawings wherein like reference characters are use throughout to designate like parts:

Figure 7:
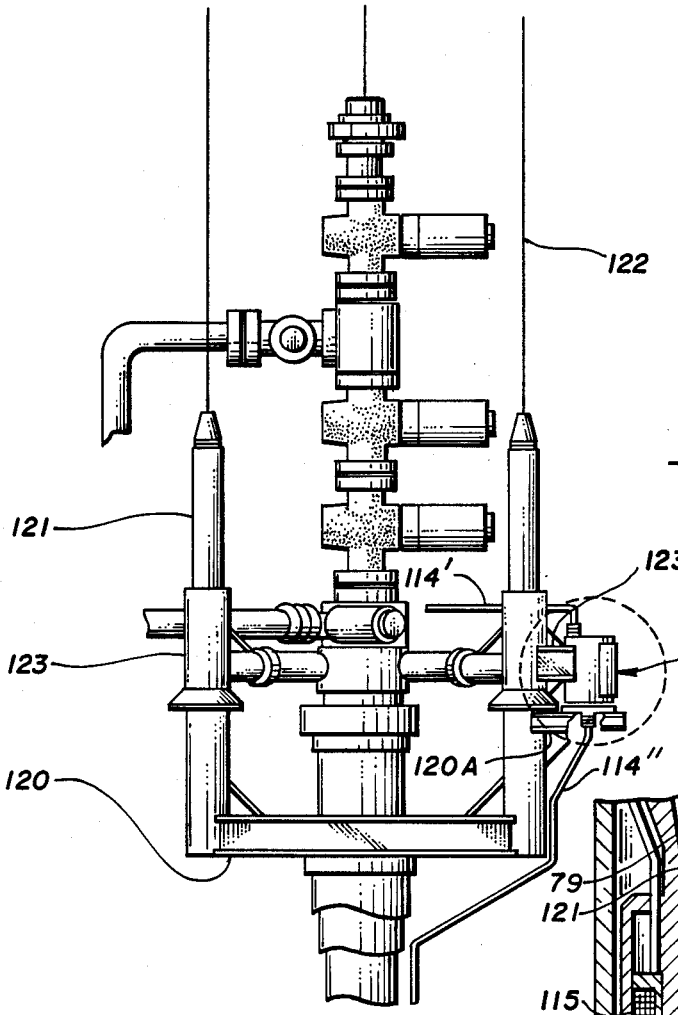
FIG. 7 is an elevational view of a subsea wellhead having a base with vertical guide posts extending upwardly therefrom and a sleeve lowered over the post, with the post and sleeve carrying coils adapted to electrically connect a source of alternating or time varying current to the connector on the wellhead.
Figure 8:
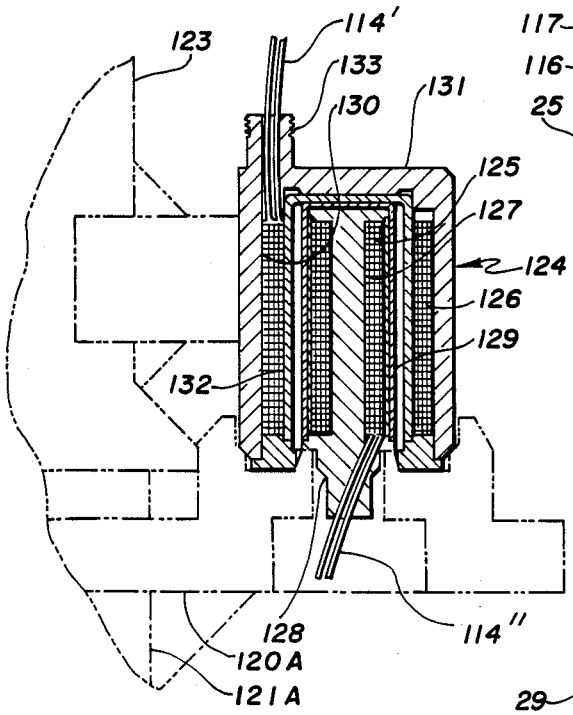
Figure 9:
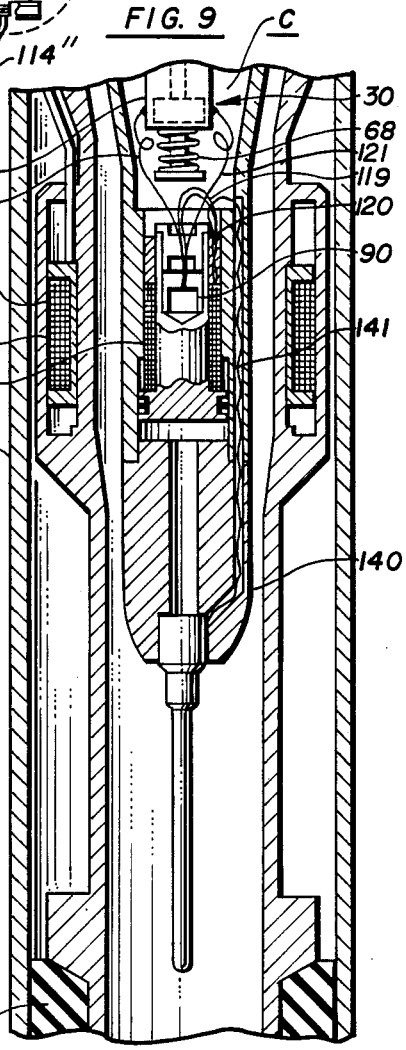

FIG. 8 is an enlarged detailed sectional view of the portion of the base circled in FIG. 7 and showing the sleeve inductively coupled with the coil on the post; and FIG. 9 is a detailed sectional view of a modification of the well installation wherein a pressure sensor is suspended from the lower end of the body on which the valve is mounted and electrically connected to the lower electrical connector to permit signals sensed by the sensor to be transmitted back to the wellhead through the apparatus for controlling the latch of the valve.

Figure 1:
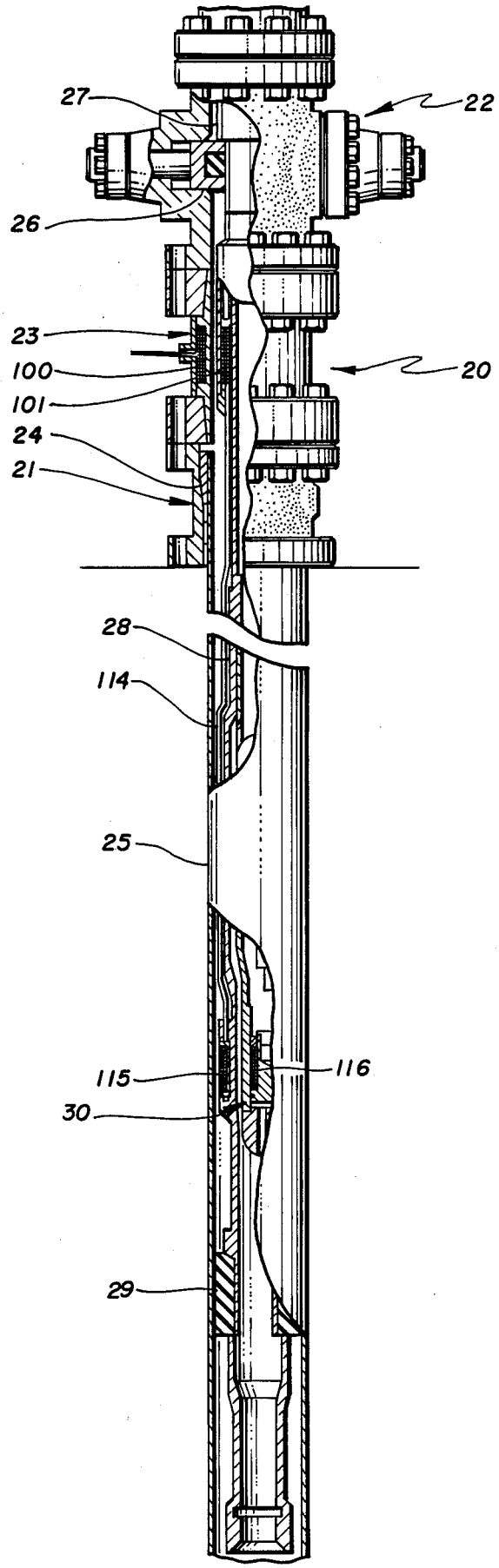
FIG. 1 is a view of a well installation, partly in vertical elevation and partly in section, and interrupted intermediate its length, including a first connector at the wellhead and a second connector generally on the level of a fail safe valve a substantial distance beneath the wellhead; for controlling flow through the tubing string suspended from the wellhead.
Figure 2:
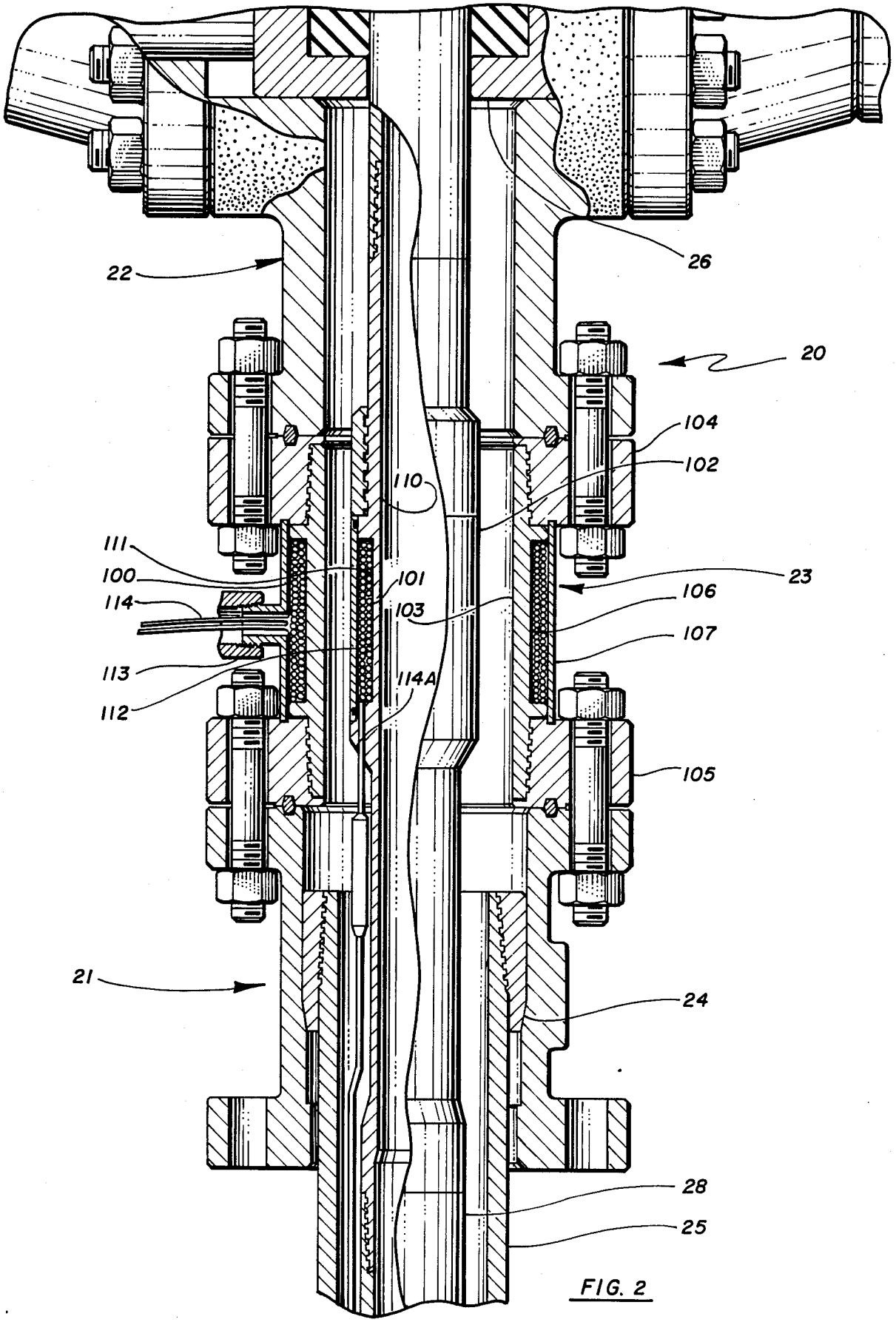
FIG. 2 is an enlarged vertical sectional view of the upper electrical connector, including a first coil mounted on a spool connected intermediate the casing and tubing heads of the wellhead, and an inner coil mounted on a tubular body suspended from the tubing hanger.

With reference now to the details of the above descried drawings, and in particular the overall well installation shown in FIG. 1, the wellhead, which is indicated in its entirety by reference character 20, includes a casing head 21 at its lower end, a tubing head 22 at its upper end, and a spool 23 mounted between the casing and tubing heads to form a continuation of the bore through them. As well known in the art, and as best shown in FIG. 2, casing hanger 24 is supported within the bore of the casing head to suspend a casing string 25 within the well bore, and the tubing head 22 has rams which may be moved inwardly to positions in which they support a shoulder about a tubing hanger 27 connected to the upper end of a tubing string 28 for suspending the tubing string within the casing string.

The lower end of the tubing string is packed off within the casing string by a packer 29 so as to confine the flow of well fluid from the formation upwardly within the tubing and into and through the wellhead to a Christmas tree (not shown) thereabove. Each of the casing and tubing strings form pressure containing walls for the well fluids in the annulus between the tubing and casing as well as within the tubing. Each of the casing hanger and tubing head rams may have means for sealing about the upper end of the casing string and the tubing hanger, respectively, in order to confine the flow of well fluid within the annulus between the casing and tubing strings for flow through side openings in the wellhead.

As shown diagrammatically in FIG. 1, and as will be described in detail in connection with FIGS. 3 to 6, a body 30 is installed in the tubing string just above the packer 29 to mount the closure member and an electrically responsive latch of a fail safe valve within the tubing string a substantial distance beneath the wellhead. More particularly, and as will also be described in detail in connection with FIGS. 3 to 6, the body and fail safe valve carried thereon are installed in the tubing string at substantially the same depth as the lower electrical connector shown in FIG. 1.

The valve which is carried by the body 30 is in many respects similar to that disclosed and claimed in copending application, Ser. No. 922,846. Thus, as shown therein as well as in FIGS. 3 to 6, it includes a tubular member 34 which is removably supported within the tubing string 28 by means of releasable locking elements (not shown) and sealed with respect thereto so that the well fluid entering the lower end of the tubing string is confined for flow through the valve as it continues to flow upwardly within the tubing to the wellhead. More particularly, the valve includes a generally cylindrical housing 38 having its open upper end threadedly and sealably connected to the lower end of tubular member 34, and having ports 39 in its side connecting the well bore beneath the lower end of the tubing string with the tubing string thereabove. A seat 41 is formed on the body between the ports and the open upper end of the housing 38, and a closure member including a sleeve 42 is vertically reciprocal within the body between an upper position in which the sleeve engages the seat to close the valve, as shown in FIGS. 3 and 4, and a lower position in which it is spaced from the seat substantially at the level of the lower end of the ports, as shown in FIGS. 5 and 6.

Figure 3:
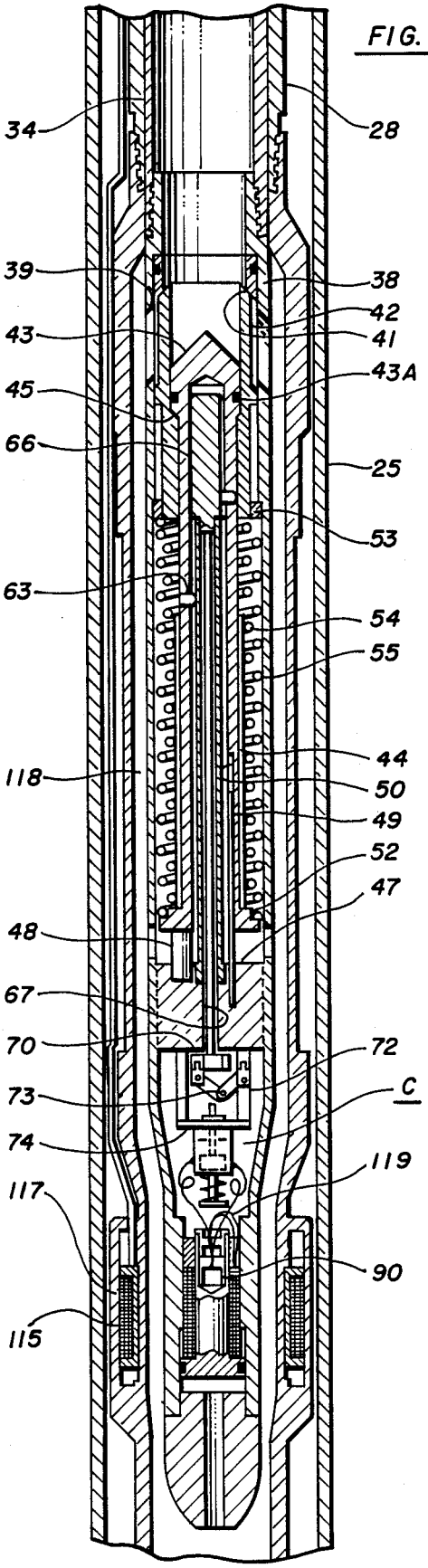
FIG. 3 is a vertical section view of the lower end of the well installation, including the lower electrical connector for supplying current to a latch for controlling the valve, but with the latch in its position to release the closure member for movement to its closed position.
Figure 4:
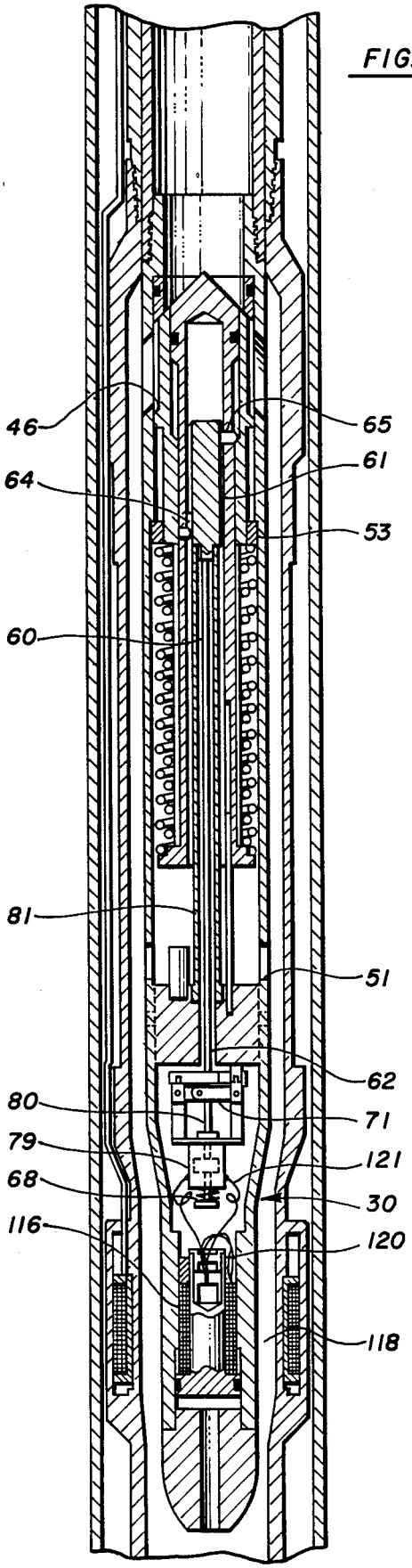
FIG. 4 is a view similar to FIG. 3, but upon lowering of well pressure above the closure member to store energy in spring means which urges a closure member sleeve to closed position and enables the latch to be moved to a position for holding the closure member in an open position in response to the supply through the connectors of electrical power to the latch.
Figure 5:
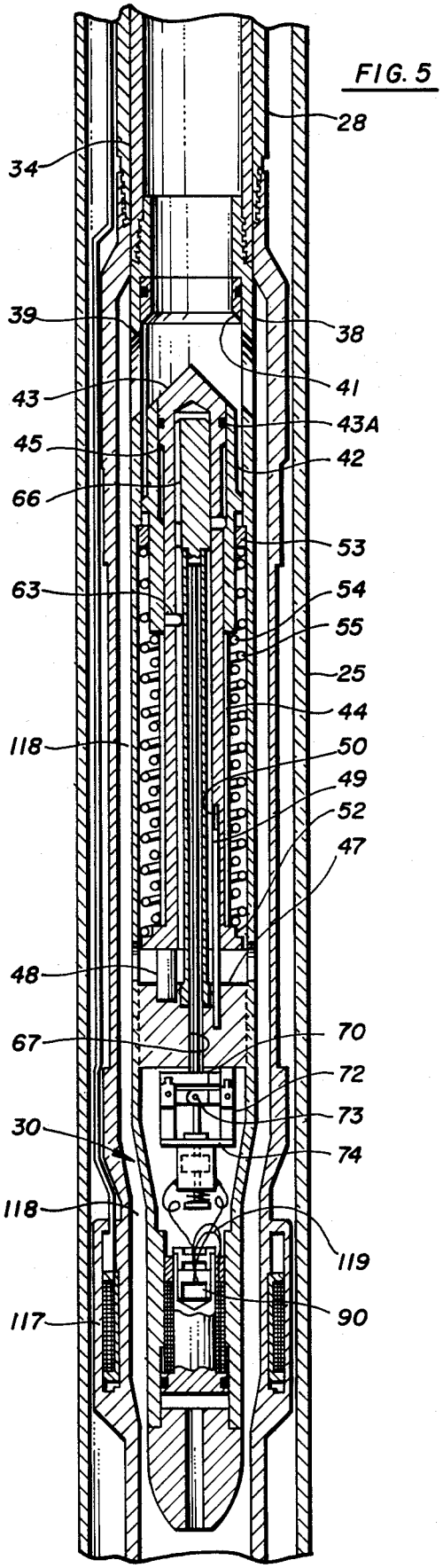
FIG. 5 is a view similar to FIG. 4, but upon an increase in pressure within the tubing string above the closure member to move the closure member to open position.
Figure 6:
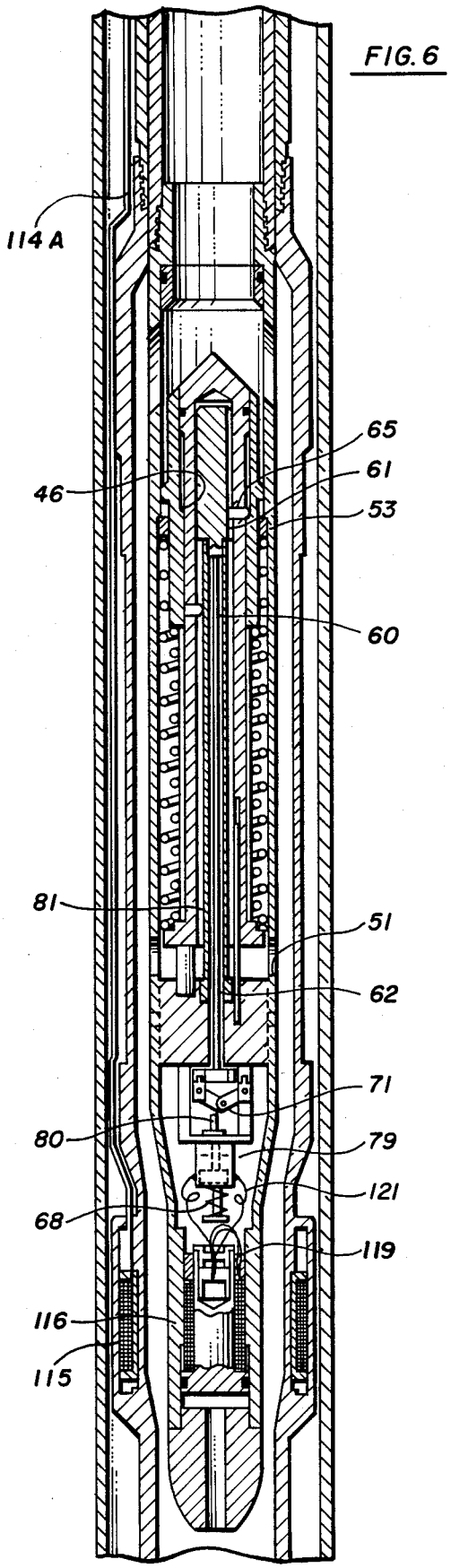
FIG. 6 is a view similar to FIG. 5, but upon the termination of the supply of current to the latch, whereby the latch is permitted to move to a position releasing the closure member for movement to the closed position of FIG. 3 in response to the urging of the spring means.

A retainer 43 is guidably reciprocable within the closure member sleeve 42 between an upper position with respect thereto, as shown in FIGS. 4, 5 and 6, wherein its upper end provides an upwardly extending conical continuation of the upper end of the sleeve, and a lower position with respect thereto, as shown in FIG. 3. The retainer is located in its upper position with respect to the closure member sleeve by the engagement of a sleeve 44 thereabout with the lower end of the closure member sleeve 42, and is located in its lower position with respect to the closure member sleeve by engagement with a shoulder 45 about the retainer with a seat 46 formed on the inner diameter of the sleeve 42. A piston 43A at the upper end of the retainer is sealably reciprocable within the closure member sleeve, so that, as will be described to follow, the retainer may be caused to reciprocate between its upper and lower positions, in order to generate energy which is used in opening, closing and reopening the valve in response to the pressure of the well fluid above and below it when closed as well as to permit the latch to be moved between its holding and releasing positions.

The body of the valve includes a transverse wall 47 which separates it into an upper chamber in which the valve closure member and retainer are disposed, and a lower chamber C which, as will be described, is maintained at atmospheric pressure and in which the latch and portions of the lower electrical connector for supplying current to the latch are contained. A pin 48 extends upwardly from the wall 47 to provide a stop for engaging the lower end of the retainer and thus limiting its downward movement with respect to the valve body. The retainer is held against rotation with respect to the body by means of a rod 49 extending upwardly from the wall 47 into a longitudinal slot 50 formed on the inner diameter of the retainer adjacent its lower end and of such length that the rod remains within it during reciprocation of the retainer with respect to the valve body. Since the upward movement of the retainer with respect to the closure member sleeve is limited by engagement of sleeve 44 with the lower end of the valve member sleeve 42, the upward movement of the retainer with respect to the body is limited by engagement of the upper end of the valve member sleeve with the seat 41 of the valve body.

Ports 51 are formed in the side of the valve body above the transverse wall 47 so that well pressure is balanced within and without the valve body beneath retainer piston 43A. Of course, when the closure member is in the open position of FIGS. 5 and 6, the pressure of the well fluid above and below the closure member is substantially the same. On the other hand, when the closure member has been moved to the closed position of FIGS. 3 and 4, well fluid above the closure member may be bled off so as to create an upwardly directed pressure differential across the closed valve which, for purposes described in the copending application, and to be described to follow, causes the retainer to be raised to the position of FIG. 4 in order to set or reset the valve for movement to its open position of FIG. 5.

The retainer has a flange 52 about its lower end, and a stop 53 is mounted on the inner diameter of the body above the flange and generally intermediate the upper and lower ends of the body. A first coil spring 54 surrounds the retainer sleeve 44 and is compressed between the lower end of the valve closure member sleeve 41 and the flange 52 so as to urge the valve closure member upwardly with respect to the retainer sleeve, and a second coil spring 55 is disposed about the first coil spring and is compressed at its opposite ends between the stop 50 and the flange so that it urges the retainer downwardly with respect to the valve body, and thus, as shown in each of FIGS. 3, 5 and 6, into a lower position in which the lower end of the retainer engages stop 48.

When the valve is closed, as shown in FIG. 3, both the first and second springs are fully expanded or deenergized. Well fluid pressure above the closure member may be bled off to cause the retainer member to rise to the position of FIG. 4, and thereby compress and energize the springs in order to store energy therein. Then, as will be described, the latch is energized by the supply of electrical current thereto in order to move to a position in which the retainer is locked in its upper position with respect to the closure member, so long as electrical current is supplied to the latch in order to set or reset the valve.

At this time, the pressure of well fluid above the closure member may be restored to substantially balance pressure across the valve, and thus permit the coil spring 55 to be deenergized or expanded so that the energy generated therein lowers the retainer and thus lowers the closure member with the retainer to open the valve, as shown in FIG. 5. As long as the electrical current is supplied to the latch, as will be described, the valve will remain open. However, when the electrical current is no longer supplied to the latch, as in response to the loss of a controlled condition, the retainer and closure member are unlocked to release the energy generated in the first coil spring 54 in order to move the closure member upwardly with respect to the retainer and into engagement with the seat 41 to close the valve, as shown in FIG. 3.

As also shown in each of FIGS. 3 to 6, a rod 60 which extends longitudinally within the retainer has an enlarged head 61 at its upper end which fits closely within the upper hollow end of the retainer and a lower end 62 which extends through a hole 67 in the transverse wall 47 of the body connecting the upper and lower chambers thereof. A pin 63 carried by the retainer projects into its inner diameter to a position beneath the enlarged head 61 of the rod when the retainer is in a lower position with respect to the rod, as shown in FIG. 3. As the retainer 43 moves upwardly, the pin 63 moves into the lower end of a slot 64 in the head of the rod, as shown in FIG. 4, which slot (as best shown in the aforementioned copending patent application) extends at an angle with respect to the vertical so as to rotate the rod approximately 10° with respect to the retainer as the retainer moves to its upper position, as shown in FIG. 4.

A pin 65 is also carried within a hole extending through the retainer at a location opposite the enlarged head 61 of the rod and thus in a position to move above shoulder 46 on the inner diameter of the sleeve as well fluid pressure above the retainer is bled off to cause it to be moved upwardly to the position of FIG. 4 and pin 63 on the retainer to move into slot 64. The resulting rotation of the head of the rod cams the inner end of pin 65 out of a slot 66 in the right side of the head and beyond the outer diameter of the retainer above the seat 46. At this time then, the retainer is locked against downward movement with respect to the valve member sleeve, and, conversely, the valve member sleeve is locked against upward movement with respect to the retainer. Since the sleeve 54 has engaged the lower end of the closure member sleeve, the retainer is held against further movement with respect to the closure member, which of course is seated and thus prevented from moving up.

The lower end 62 of the rod which extends through hole 67 in the wall 47 is connected to an arm 50 within the atmospheric chamber C so as to rotate the arm as the retainer moves upwardly from the position of FIG. 3 to the position of FIG. 4, and thus as the pin 63 moves into the slot 64 in the head of the upper end of the rod so as to transmit rotation to the rod relative to the retainer. Each outer end of the arm 70 is pivotally connected to one arm of toggle links 71 having its other arm pivotally connected to a bracket 72 extending downwardly from the transverse wall 47 within the atmospheric chamber, and the arms of the toggle links are connected to one another by means of a rod 73 extending between them. As will be understood from the drawings, rotation of the arm 70 with the control rod 60 will move the outer ends of the toggle links further apart, and thus move the toggle links from the collapsed position of FIG. 3 to the extended position of FIG. 4. Swivel pin connections are provided between the ends of the arms and the links, as well as between the brackets and the links.

A platform 74 is suspended from the lower side of the transverse wall 47 by bracket arms extending downwardly from the wall to support a latch in the form of a solenoid 79 with an extendable and retractable armature or end 80. When the toggle links are extended, the solenoid is energized, as will be described, to raise the end 80 of the solenoid to the position shown in FIG. 4 to hold the links extended so long as the supply of current is maintained. On the other hand, when the supply is lost, as shown in FIG. 6, the solenoid is inoperable to oppose the force of a small spring acting 68 between the body of the solenoid and an end of the solenoid opposite the end 80. Thus, the latch permits the links to move off dead center and collapse, in response to rotation of the control rod, as shown in FIG. 6, and thus release the closure member for upward movement from the position of FIG. 6 to the position of FIG. 3.

A torque tube 81 surrounds the control rod and is anchored at one end to the transverse wall 47 of the valve body and at the upper end of the head of the control rod. The torque tube thus provides a spring force for urging the control rod from the position of FIG. 5 to the position of FIG. 6 so as to rotate the enlarged upper end of the control rod to a position in which slot 66 is opposite the inner end of pin 65. Thus, as shown in FIG. 3, the pin may be urged inwardly from above shoulder 46 and into slot 66 to free the closure member sleeve for moving upwardly with respect to the retainer, and thus from the position of FIG. 6 into the closed position of FIG. 3 in engagement with the seat 41. Also, of course, the torque tube closes the annular space about the rod as the rod rotates between its alternate positions and thus closes the chamber C.

To summarize operation of the valve, and assuming it to be in the reset position of FIG. 4 wherein energy is generated in both of the coil springs, and the solenoid has been activated to engage its end 80 with the rod 73 extending between the toggle links, and thus hold the toggle links in extended position, well pressure may be equalized across the closed valve member to permit energy generated in coil spring 55 to be released in order to move both the closure member and the retainer downwardly from the closed position of FIG. 4 to the open position of FIG. 5. Although this removes pin 63 from slot 64, the rod is not free to rotate, and the pin 65 continues to remain in a locked position to hold the retainer in its upper position with respect to the closure member, as long as the solenoid latch is rendered operative. However, when the solenoid is rendered inoperative, upon the loss of the supply of electrical current thereto, spring 68 moves the toggle links off center to permit them to be collapsed by the spring force in the torque tube. As the arm 70 is so rotated, the head at the upper end of the control rod is rotated to a position in which the slot 66 therein is opposite the pin 65 so as to receive the pin, as shown in FIG. 6, and thereby unlock the retainer and closure member sleeve to permit the sleeve to be moved upwardly by the inner coil spring 54 from its lower position with respect to the retainer to its upper position with respect thereto and thus to move the upper end of the closure member into engagement with the seat 41 to close the valve, as shown in FIG. 3.

To the extent above described, the valve is similar to that shown and described in the aforementioned patent application, Ser. No. 922,846. However, in accordance with the illustrated embodiment of the present invention, solenoid 79 is electrically connected to the lower connector, and thus with the source of electrical power at the wellhead, by means of conductors leading from the connection to a rectifier 90 and by further conductors from the rectifier to the solenoid in order to convert the alternating or time varying current from the source at the wellhead to direct or constant polarity current for controlling the solenoid latch. So long as the current is supplied to energize the solenoid latch, and well pressure has been bled off above the closure member, as shown in FIG. 4, the links are held extended to hold the valve open.

Returning now to a description of the apparatus for supplying electrical current from the power source (not shown) outside the wellhead to the lower connector and thus to the electrically responsive latch of the tubing safety valve, the aforementioned upper connector is best shown in FIG. 2 to comprise a first annular coil 100 mounted on the spool 23 in concentric, surrounding relation to a second annular coil 101 carried on a tubular body 102 suspended from the tubing hanger and connected at its lower end to the tubing string 28 extending downwardly within the casing 25. The spool 23 comprises an inner tubular member 103 which is threadedly connected at its upper and lower ends to flanges 104 and 105, respectively, having bolt holes therethrough to permit them to be bolted to the lower flange of the tubing head 22 and the upper flange of the casing head 21.

The outer side of the tubular member 103 is recessed at 106 and is surrounded by an outer tubular member 107 which is held concentrically with respect thereto by the flanges 104 and 105 to form a space with the recess 106 in which the first coil 100 is enclosed. The tubular body 102 suspended from the tubing hanger includes an inner tubular member 110 threadedly connected at its upper end to the lower end of the tubing hanger and threadedly connected at its lower end to the upper end of the tubing string. The outer side of tubular member 110 is recessed at 111 to receive the inner or second annular coil 101 in a position concentrically within and opposite the coil 100 when the tubing hanger is suspended from the wellhead, as shown in FIG. 2. The tubular body further includes an outer wall 112 which surrounds and is connected to the inner tubular member so as to enclose the inner coil 101.

An inlet is formed in the outer wall 107 to permit a first conductor 114 in the form of a pair of wires to extend therethrough into connection with the coil 100. The inner tubular member 103 of the spool and the outer tubular member 112 of the tubular body 102 are formed of a suitable non-magnetic material so that when alternating or time varying current is supplied from the source and through the conductors 114 to the coil 101, the coils 100 and 101 are inductively coupled. Current is thus supplied from the coil 101 of the inductive coupling to a conductor 114A which passes out of the body 110 and extends downwardly within the annulus between the tubing string and casing suspended from the casing head.

As shown in FIG. 1, the conductor 114A extends downwardly to an outer annular coil 115 of the lower connector which is mounted on the tubing a substantial distance beneath the wellhead and near the inner body 30 on which the safety valve and its latch are mounted when the body is landed in the tubing. The second or lower connector also includes an inner annular coil 116 which is carried on the body 30 concentrically within and opposite the coil 115. More particularly, the outer coil 115 is carried within an annular space formed in a tubular nipple 117 connected as a part of the tubing string and having an enlarged bore above the connector opposite and spaced from the body 30 so as to form an annular space 118 connecting the tubing beneath the body 30 with ports 39 in the valve assembly leading to the tubing string above the valve assembly. As shown in FIGS. 3 to 6, the lower end of the conductor 114A extends into the space within the nipple in which the outer coil 115 is disposed for connecting with the coil in order to supply electrical current from the second coil of the first connector to the coil 115. More particularly, the pressure containing wall on the inner side of the nipple 117 opposite the coil 115 and the outer side of the body 30 opposite the coil 116 are formed of non-magnetic material, whereby the supply of current to the outer coil 115 will form an inductive coupling between the outer and inner coils.

As previously described, and as shown in FIGS. 3 to 6, a further conductor connecting the inner coil 116 to the solenoid latch 79 comprises a first conductor section 119 comprising a pair of wires connecting the inner coil with the rectifier 90, and a second section 121 having a pair of wires connecting the rectifier with the solenoid 79, whereby the alternating or time varying current from the lower connector is converted to direct or constant polarity current for energizing the solenoid.

As previously described, the coils of the upper and lower connectors may be assembled on their respective supporting parts, the outer coil 100 of the upper connector being first positioned upon installation of the wellhead. Then, during completion of the well, inner coil 101 of the upper connector and outer coil 115 of the lower connector are properly positioned upon lowering of the tubing hanger into supported position within the tubing head. Finally, the inner coil 116 of the lower connector is properly positioned upon lowering the valve assembly into the tubing. Conversely, in the event the well is to worked over, the tubing string need only be raised and then lowered back into place, or in the event the valve assembly or parts mounted in the body 30 are to be repaired or replaced, the body need only be raised and lowered back into place so as to automatically reposition the connectors.

As previously described, FIG. 7 shows the subsea wellhead of a well installation which may be similar to that above described in that a safety valve assembly having an electrically responsive latch is installed in the tubing thereof a substantial depth below the wellhead. It is conventional for such wellheads to have a base 120 near the ocean floor for the purpose of facilitating the lowering and raising of various parts, such as a Christmas tree, into and out of position on the wellhead. Thus, the base includes posts 121 which extend upwardly at spaced apart locations about the casing head and flexible guide lines 122 extending therefrom to the surface level. As well known in the art, sleeves 123 are connected to the tree or other equipment to be installed and spaced thereabout for fitting closely over the posts 121 as they are lowered along the lines 122 to land the equipment on the wellhead.

In accordance with the present invention, one of the posts and the sleeve to be lowered thereover carry parts on which coils are mounted to make up another electrical connector 124 for supplying electrical current from a source of electrical power (not shown) to the electrically responsive device within the well. Thus, for example, the connector 124 may be made up intermediate the source and an upper connector (not shown) at the wellhead, and, for this purpose, the conductor 114 previously described in connection with FIGS. 3 to 6 includes a first section 114$^{I}$ leading from the source to one part of the connector 124 and a second section 114$^{II}$ connecting the other part thereof with the outer coil of the upper connector on the wellhead.

As best shown in FIG. 8, the connector 124 includes an inner annular coil 125 which is mounted on and extends upwardly from an arm 120A extending from one of the posts, and an outer annular coil 126 mounted on an arm 123A extending from the sleeve to be lowered over the one post. More particularly, the arms are so oriented so as to cause the outer annular coil to be moved vertically over the inner annular coil as the sleeve is lowered onto the post, thereby automatically bringing the outer coil 126 into a position opposite and concentric with respect to the inner coil 125.

More particularly, the inner coil 125 is disposed within a recess 127 about an upright body and an outer tubular member 129 of non-magnetic material is disposed over the body 127 and about the coil 125 so as to enclose same. The outer coil 126, on the other hand, is received within an annular recess 130 received within a tubular body 131 and an inner wall 132 of non-magnetic material is mounted within the tubular body 131 and over the inner side of the coil 126 so as to enclose same.

As also shown in FIG. 8, conductor section 114$^{I}$ extends through an inlet 133 in the upper end of the tubular body 131, and the conductor section 114B extends outwardly through a hole in the lower end of the body 128. As will be appreciated, upon the supply of alternating or time varying current from the source to the outer coil 126, the inner and outer coils are inductively coupled, so that current is supplied through the conductor section 114$^{II}$ to other parts of the wellhead for use in supplying electrical current to the electrically responsive device within the well. More particularly, and as previously mentioned, the conductor section 114$^{II}$ may lead to the outer coil of an upper connector similar to that best shown and described in connection with FIG. 2.

As shown in FIG. 9, a device 140 may be installed on the lower end of the body 30 supporting the valve assembly so as to positioned for sensing pressure within the tubing therebelow. The sensor is electrically connected to the inner coil 116 of the lower connector shown in FIGS. 3 to 6, as by wires connecting it in parallel to the wires 141 extending from the inner coil to the rectifier 90. Thus, signals indicative of the pressure within the tubing may be transmitted through the apparatus including the connectors previously described to permit the sensed signals to be read at the wellhead. Obviously, the device may be used for sensing other phenomena within the well such as temperature.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A well installation, comprising a wellhead including a casing head and a tubing head above the casing head, casing extending downwardly from the casing head into the well bore, tubing suspended from the tubing head and extending downwardly within the casing, valve means including a closure member moveable within the tubing for opening and closing the tubing a substantial distance beneath the wellhead, means urging the closure member toward closed position, a latch which is movable to and maintained in a position holding the closure member in open position, in response to the supply of electrical current thereto, and which is permitted to move to a position releasing the closure member for movement to closed position in response to the loss of said supply, a source of alternating or time varying current outside the wellhead, and an electric connector including a first annular coil mounted about a non-magnetic portion of the wellhead, a second annular coil mounted on the tubing concentrically within and generally opposite the first coil, a first conductor extending from the source of current outside the wellhead to the first coil to supply alternating or time varying current thereto in order to inductively couple the first and second coils, and means for controlling movement of the latch including a second conductor extending from the second coil downwardly between the casing and tubing for supplying electrical current to the latch.

2. A well installation as described in claim 1, wherein a second electrical connector, a third annular coil about a non-magnetic portion of the tubing, and a fourth annular coil mounted on the body concentrically of and generally opposite the first coil, said second conductor extending to the first coil of the second electrical connector so as to form an inductive coupler between the third and fourth coils thereof, and a third conductor within the body leading from the fourth coil of the second connector to the latch for supplying electrical current thereto.

3. A well installation as described in claim 2, wherein said valve means includes means responsive to the establishment of a pressure differential within the tubing and across the closure member, when in closed position, to move the closure member to open position whereby, upon return of the latch to holding position and the supply of electrical current to the third coil of the second connector, the closure member is maintained in its open position by the latch.

4. A well installation as described in claim 2, wherein said latch includes a solenoid, and the controlling means includes a rectifier for converting alternating on time varying current supplied by the third conductor into direct or constant polarity current.

5. A well installation, comprising a wellhead including a casing head and a tubing head above the casing head, casing extending downwardly from the casing head into the well bore, tubing suspended from the tubing head and extending downwardly within the casing, valve means including a closure member moveable within the tubing for opening and closing the tubing a substantial distance beneath the wellhead, means urging the closure member toward closed position, a latch which is movable to and maintained in a position holding the closure member in open position, in response to the supply of electrical current thereto, and which is permitted to move to a position releasing the closure member for movement to closed position in response to the loss of said supply, a source of alternating or time varying current outside of the wellhead, and an electrical connector including a first coil mounted outside a non-magnetic portion of the wellhead, a second coil mounted on the tubing generally opposite the first coil, a first conductor extending from the source to the first coil to supply current thereto in order to inductively couple the first and second coils, and means for controlling movement of the latch including a second conductor extending from the second coil downwardly between the casing and tubing for supplying electrical current to the latch.

6. A well installation as described in claim 5, wherein said latch is mounted within a body spaced from the tubing, and said controlling means also comprises a second electrical connector including a third coil mounted outside a non-magnetic portion of the tubing, and a fourth coil mounted on the body generally opposite the third coil, said second conductor extending to the third coil of the second electrical connector so as to form an inductive coupler between the third and fourth coils thereof, and a third conductor within the body leading from the fourth coil of the second connector to the latch for supplying electrical current thereto.

7. A well installation as described in claim 6, wherein said valve means includes means responsive to the establishment of a pressure differential within the tubing and across the closure member, when in closed position, to move the closure member to open position, whereby, upon return of the latch to holding position and the supply of electrical current to the third coil of second connector, the closure member is maintained in its open position by the latch.

8. A well installation as described in claim 7, wherein said latch includes a solenoid, and the controlling means includes a rectifier for converting alternating or time varying current supplied by the third conductor into direct or constant polarity current.

9. A wellhead, comprising a casing head, a casing hanger supportable within the casing head for suspending the casing within a well bore, a tubing head adapted to be mounted above the casing head, a tubing hanger supportable within the tubing head for suspending tubing within the casing, and a connector for supplying alternating current from a source outside the wellhead to an electrically responsive device within the well, including a first annular coil mounted about a non-magnetic portion of the casing head, a second annular coil mounted on a tubular body suspended from the tubing hanger to dispose the second coil concentrically within and generally opposite the first coil when the tubing hanger is supported from the wellhead, a first conductor extending from the source to connect with the first coil in order to supply alternating or time varying current thereto and thereby form an inductive coupler between the first and second coils, and a second conductor extending from the second coil for supplying said electrical current to the device.

10. A wellhead as described in claim 9, wherein said first coil is mounted on a spool connected as part of the wellhead intermediate the tubing and casing heads.

11. A wellhead, comprising a casing head, a casing hanger supportable within the casing head for suspending a casing within a well bore, a tubing head adapted to be mounted above the casing head, a tubing hanger supportable within the tubing head for suspending tubing within the casing, and a connector for supplying alternating or time varying current from a source outside the wellhead to an electrically responsive device within the well, including a first coil outside a non-magnetic portion of the casing head, a second coil mounted on a tubular body suspended from the tubing hanger to dispose the second coil generally opposite the first coil when the tubing hanger is supported from the wellhead, a first conductor extending from the source to connect with the first coil in order to supply alternating or time varying current thereto and thereby form an inductive coupler between the first and second coils, and a second conductor extending from the second coil for supplying said electrical current to the device.

12. A wellhead as described in claim 11, wherein said first coil is mounted on a spool connected as part of the wellhead intermediate the tubing and casing heads.

13. A wellhead as described in claim 11, wherein said wellhead is disposable at a subsea location and there is a base about the wellhead having vertical posts spaced about the wellhead to permit equipment to be guided into position at the wellhead, and wherein said connector also includes a third coil mounted on a post, and a fourth coil mounted on a sleeve for disposal generally opposite the third coil as the sleeve is lowered over the post, and said first conductor includes a first section extending between the first coil outside the casing head and the third coil on the post, and a second section extending from the power source to the second coil on the sleeve.

14. A downhole valve assembly, comprising a pressure containing tubular member connectable as part of a well tubing a substantial distance below the wellhead, a body disposable concentrically within the tubing and including a valve having a closure member for movement between positions opening and closing the tubing, and means for controlling movement of the closure member in response to the supply of electrical current thereto, a connector including a first annular coil about a non-magnetic portion of the tubular member, a second annular coil on the body for disposal generally opposite the first coil, a first conductor extending into connection with the first coil for supplying alternating or time varying current thereto from a source outside the well in order to form an inductive coupler between the first and second coils, and a second conductor extending from the second coil for connection with the controlling means.

15. For use in a well having outer and inner well conduits arranged concentrically of one another to form a first outer annulus therebetween in which fluid pressure is contained, and an electrically responsive device mounted on a body spaced concentrically within the inner conduit to form an annular space therebetween in which fluid pressure is contained, apparatus for supplying electrical power to the device from a source of alternating or time varying current outside the outer conduit, comprising, a first connector including a first annular coil adapted to be mounted on and about a non-magnetic portion of the outer well conduit, and a second annular coil adapted to be mounted on the inner well conduit for disposal concentrically within and generally opposite the first coil, a first conductor for supplying current from the source to the first coil in order to form an inductive coupling between the first and second coils, a second connector including a third annular coil adapted to be mounted about a non-magnetic portion of the inner well conduit, and a fourth coil adapted to be mounted on the body to dispose the second coil concentrically within and generally opposite the first coil, a second conductor extending within the annulus to connect the second coil of the first connector with the third coil of the second connector to thereby form an inductive coupling between the third and fourth coils of the second connector, and a third conductor extending from the fourth coil of the second connector to connect with the device.

16. Apparatus of the type described in claim 15, wherein the first connector is at the head of the well, and the device and the second connector are a substantial depth beneath the wellhead.

17. In a well having outer and inner well conduits arranged concentrically of one another to form a first outer annular space therebetween in which fluid pressure is contained, and an electrically responsive device mounted on a body spaced concentrically within the inner conduit to form a second inner annular space therebetween in which fluid pressure is contained, apparatus for supplying electrical power to the device from a source of alternating or time varying current outside the well, said apparatus comprising a first connector including a first annular coil disposed about a non-magnetic portion of the outer well conduit, and a second annular coil mounted on the inner well conduit concentrically of and generally opposite the first coil, a first conductor for supplying current from the source to the first coil in order to form an inductive coupling between the first and second coils, and a second conductor including a third annular coil disposed about a non-magnetic portion of the inner well conduit, and a fourth coil mounted on the body concentrically of and generally opposite the first coil, a second conductor extending within the outer annular space to connect the second coil of the first connector with the third coil of the second connector to form an inductive coupling between the third and fourth coils of the second connector, and a third conductor extending from the fourth coil of the second connector to connect with the device.

18. Apparatus of the character described in claim 17, wherein the first connector is at the head of the well, and the device and the second connector are a substantial depth beneath the wellhead.

19. In a well having outer and inner well conduits arranged concentrically of one another to form a first outer annular space therebetween in which fluid pressure is contained, and an electrically responsive device mounted on a body spaced concentrically within the inner conduit to form a second inner annular space therebetween in which fluid pressure is contained, apparatus for supplying electrical power to the device from a source of alternating or time varying current outside the outer conduit, said apparatus comprising a first connector including a first coil outside a non-magnetic portion of the outer well conduit, and a second coil mounted on the inner well conduit generally opposite the first coil, a first conductor extending from the source to the first coil for supplying current thereto in order to form an inductive coupling between the first and second coils, a second connector including a third coil outside a non-magnetic portion of the inner well conduit, and a fourth coil mounted on the body generally opposite the first coil, a second conductor extending within the outer annular space from the second coil of the first connector to the third coil of the second connector to thereby form an inductive coupling between the third and fourth coils of the second connector, and a third conductor extending from the fourth coil of the second connector to connect with the device.

20. Apparatus of the character described in claim 19, wherein the first connector is at the head of the well, and the device and the second connector are a substantial depth beneath the wellhead.

21. For use in a well having a pressure containing wall and an electrical responsive device inside the wall, a connector for supplying electrical power to the device from a source of alternating or time varying current outside the wall, said connector comprising a first annular coil adapted to be mounted on and about a non-magnetic portion of the wall, a second annular coil adapted to be mounted on a body for disposal concentrically within and generally opposite the first coil, a first conductor for supplying current from the source to the first coil in order to form an inductive coupler between the first and second coils, and a second conductor extending from the second coil for supplying said electrical current to the device, the wall and body being outer and inner well conduits which are disposable in spaced relation to form an annular space therebetween for fluid pressure contained between them.

22. A connector of the type described in claim 21, wherein the well conduits are disposable at the head of the well.

23. For use in a well having a pressure containing wall and an electrical responsive device inside the wall, a connector for supplying electrical power to the device from a source of alternating or time varying current outside the wall, said connector comprising a first annular coil adapted to be mounted on and about a non-magnetic portion of the wall, a second annular coil adapted to be mounted on a body for disposal concentrically within and generally opposite the first coil, a first conductor for supplying current from the source to the first coil in order to form an inductive coupler between the first and second coils, and a second conductor extending from the second coil for supplying said electrical current to the device, the wall is an inner well conduit disposable within the well a substantial distance below the head of the well, and the device is carried within the body which is spaced from the well conduit to form an annular space therebetween for the contained fluid pressure.

24. In a well having a pressure containing wall and an electrical responsive device inside the wall, a connector for supplying electrical power to the device from a source of alternating or time varying current outside the wall, comprising a first annular coil disposed about the wall, a second annular coil disposed within the wall concentrically of an generally opposite the first coil, said wall including an annular non-magnetic portion between the coils, a first conductor extending from the source to the first coil for supplying current thereto in order to form an inductive coupler between the first and second coils, and a second conductor extending from the second coil for supplying said electrical current to the device, wherein the non-magnetic portion of the well conduit is at the head of the well.

25. In a well having a pressure containing wall and an electrical responsive device inside the wall, a connector for supplying electrical power to the device from a source of alternating or time varying current outside the wall, comprising a first annular coil disposed about the wall, a second annular coil disposed within the wall concentrically of an generally opposite the first coil, said wall including an annular non-magnetic portion between the coils, a first conductor extending from the source to the first coil for supplying current thereto in order to form an inductive coupler between the first and second coils, and a second conductor extending from the second coil for supplying said electrical current to the device, wherein the non-magnetic portion of the well conduit is a substantial distance below the head of the well.

26. In a well having a pressure containing wall and an electrical responsive device inside the wall of a well conduit, a connector for supplying electrical power to the device from a source of alternating or time varying current outside the wall, comprising a first coil outside the wall, a second coil inside the wall generally opposite the first coil, said wall including a non-magnetic portion between the coils, a first conductor extending from the source to the first coil for supplying current thereto in order to form an inductive coupler between the first and second coils, and a second conductor extending from the second coil for supplying said electrical current to the device, wherein the non-magnetic portion of the well conduit is at the head of the well.

27. In a well having a pressure containing wall and an electrical responsive device inside the wall of a well conduit, a connector for supplying electrical power to the device from a source of alternating or time varying current outside the wall, comprising a first coil outside the wall, a second coil inside the wall generally opposite the first coil, said wall including a non-magnetic portion between the coils, a first conductor extending from the source to the first coil for supplying current thereto in order to form an inductive coupler between the first and second coils, and a second conductor extending from the second coil for supplying said electrical current to the device, wherein the non-magnetic portion of the well conduit is a substantial distance below the head of the well.

* * * * *